United States Patent [19]

Nakamura

[11] Patent Number: 4,946,154

[45] Date of Patent: Aug. 7, 1990

[54] AFTER-PROCESSING APPARATUS FOR A COPYING MACHINE

[75] Inventor: Tsuyoshi Nakamura, Kanagawa, Japan

[73] Assignee: Fuji Xerox Co., Ltd., Tokyo, Japan

[21] Appl. No.: 233,529

[22] Filed: Aug. 18, 1988

[30] Foreign Application Priority Data

Aug. 20, 1987 [JP] Japan ..... 62-205192

[51] Int. Cl.[5] ..... B42B 2/00

[52] U.S. Cl. ..... 270/53; 270/58

[58] Field of Search ..... 270/53, 37, 58

[56] References Cited

U.S. PATENT DOCUMENTS

| | | | |
|---|---|---|---|
| 4,083,550 | 4/1978 | Pal | 260/53 |
| 4,564,185 | 1/1986 | Hamlin | 270/53 |
| 4,782,363 | 11/1988 | Britt | 270/53 |

FOREIGN PATENT DOCUMENTS

| | | | |
|---|---|---|---|
| 43-14142 | 6/1968 | Japan . | |
| 47-30491 | 9/1972 | Japan . | |
| 50-91422 | 7/1975 | Japan . | |
| 51-11974 | 4/1976 | Japan . | |
| 59-68977 | 5/1984 | Japan . | |
| 59-43765 | 10/1984 | Japan . | |
| 59-196297 | 11/1984 | Japan . | |
| 145069 | 12/1984 | Japan | 270/58 |
| 62-59002 | 3/1987 | Japan . | |

*Primary Examiner*—Edward K. Look
*Assistant Examiner*—Therese M. Newholm
*Attorney, Agent, or Firm*—Finnegan, Henderson, Farabow, Garrett, and Dunner

[57] ABSTRACT

A copying machine is provided with an after-processing apparatus for automatically binding or clipping photocopies together. The apparatus contains an automatic stapling unit and an automatic clip-fitting unit so the operator can choose whether the photocopies are to be stapled or clipped. The automatic clip-fitting unit may also include a projection to open the clips before they are placed on the photocopies.

3 Claims, 4 Drawing Sheets

AFTER-PROCESSING APPARATUS FOR A COPYING MACHINE

FIELD OF THE INVENTION

The present invention relates to an apparatus for automatically binding sheets of paper together. More specifically, the present invention relates to an apparatus for binding together copies made by a copying machine with an optional binding piece such as a staple or a clip.

BACKGROUND OF THE INVENTION

When the copies P of originals are made by a copying machine, the copies are bound together by a staple 90 or clip 80 as shown in FIGS. 12(*a*) and 12(*b*), to prevent the copies from scattering from each other and to facilitate the handling of the copies. If the copies are to be bound together by the clip 80, the copy machine operator usually fits the clip to the copies by hand. If the copies are to be bound together by a staple 90, the operator usually uses a manual stapler. Since the burden on the operator in binding a relatively small number of copies together is relatively low, the copies can generally be quickly and easily bound together.

If a larger number of copies are to be bound together, a finisher 3 is sometimes coupled to a copying machine to organize the copies and bind them together by a staple. The finisher 3 is provided with a sorter or the like and with a staple driving unit. The copies P made by the copying machine 1 are automatically sorted so that the copies taken out of the tray of the sorter or remaining in the tray are bound together by a staple 90 at the corners of the copies as shown in FIG. 14(*a*).

In a conventional prior art device, disclosed in Japanese Patent Application No. 43765/84, a copying machine is provided with a finisher so that copies sent into the compiling tray of the finisher are aligned, bound together with a staple by a staple driving unit, and discharged into a discharge tray.

In another conventional prior art device, disclosed in Japanese Patent Application (OPI) No. 59002/87 (the term "OPI" meaning an "unexamined published application"), a finisher provided with a sheet folder and a sheet binder is coupled to a copying machine. Large copies are automatically folded in half or into a Z form or the like to a desired size and are then automatically stapled together by the sheet binder.

Automatically binding copies together with a staple as described above facilitates the handling of the copies, and greatly reduces the burden on the operator of the copying machine.

Photocopies are also often bound together with a Zem clip or the like. Such clips are illustrated in FIGS. 7–10. There have been no devices for automatically fitting the Zem clip or the like to the sheets of paper from a copying machine. Therefore, the Zem clip or the like is fitted to the sheets of paper by manually increasing the distance between the inner and outer rings of the Zem clip or the like and then inserting the sheets of paper between the inner and outer rings. This manual way of fitting the Zem clip or the like to the sheets of paper is not a problem for the operator if the number of the sheets of paper is small.

Devices for manual clip fitting have been developed in the prior art. Devices for manual Zem clip fitting were disclosed in Japanese Patent Application No. 14142/68 and Japanese Utility Model Application No. 30491/73. In the device disclosed in Japanese Patent Application No. 14142/68, the tips of the inner and outer rings of a Zem clip are bent away from each other so that sheets of paper may be inserted between the bent tips of the inner and outer rings to bind the sheets of paper together. It is unnecessary to open the tips of the inner and outer rings of the Zem clip away from each other in fitting the Zem clip to the sheets of paper. In the device disclosed in the Japanese Utility Model Application No. 30491/73, a guide is provided to open the tips of the inner and outer rings of a Zem clip as the Zem clip is sent out from a clip holder. When the Zem clip is pushed out from the clip holder, the tips of the inner and outer rings of the clip are opened by the guide to make it easy to fit the Zem clip to sheets of paper.

Devices wherein a clip made of an almost circularly bent wire is automatically fitted to sheets of paper are disclosed in Japanese Patent Application No. 11974/76 and Japanese Patent Application (OPI) No. 91422/75. Since the tips of the inner and outer rings of the clip can be easily opened by hand, the sheets of paper can be easily bound together by the clip made of the almost circularly bent wire.

Devices in which a clip made of a spring plate bent in half is fitted to sheets of paper were disclosed in Japanese Patent Application (OPI) No. 196297/84 and Japanese Utility Model Application (OPI) No. 68977/84. Such a clip is shown in FIG. 11. However, the clip does not have handles and the tips of the portions of the clip cannot be opened by hand so as to be placed over the sheets of paper. Therefore, a means for opening the tips of the portions of the clip to insert the sheets of paper between the tips must be provided to fit the clip to the sheets of paper.

Referring to the above-mentioned conventional devices for binding sheets of paper together using a staple, there is a problem in that the stapled portions of the sheets of paper are relatively weak and are likely to become unbound from each other. For example, if the sheets of paper bound together by the staple are to be copied, the staple should be removed from the sheets of paper before the copying and the sheets must be restapled after the copying. If the staple is large and thick, it is difficult to remove the staple from the sheets of paper and the sheets of paper may be torn when the staple is removed.

As for the above-mentioned conventional devices for binding the sheets of paper together with a clip, a Zem clip in particular, the sheets of paper bound together can be easily unbound for photocopying and can also be easily bound together again. However, in the past none of the clips can be automatically inserted from a finisher for a copying machine, as have the above-mentioned staple-binding devices. Therefore, the clip must be manually fitted to the photocopies. In other words, when the above-described clip binding devices are used, the operator must manually align or true up the sheets of paper and then bind them together by the clip after performing the copying. For that reason, the burden on the operator is heavy and his efficiency is lowered.

SUMMARY OF THE INVENTION

An object of the present invention is an after-processing apparatus that is coupled to a copying machine so as to bind copies together.

Another object of the present invention is an after-processing apparatus, which comprises a staple driving unit and a clip fitting unit designed so that either of the units can be used depending on the binding mode selected.

A further object of the present invention is an after-processing apparatus wherein either the staple driving unit or the clip fitting unit can be set in a prescribed position at a binding position of a compiling tray by a moving mechanism such as a solenoid so as to bind copies together.

These and other objects are accomplished by an after-processing apparatus adapted to be coupled to a copying machine for binding together copies made by the machine comprising a compiling tray for accumulating and aligning the copies to be bound, and a binding device comprising a staple driving unit and a clip fitting unit, the staple driving unit and the clip fitting unit being selectable by an operator such that the copies are bound by a staple or a clip.

BRIEF DESCRIPTION OF THE DRAWINGS

The manner by which the above objects and other objects, features, and advantages of the present invention are attained will be fully apparent from the following description when considered in view of the drawings, wherein:

FIG. 14(*b*) illustrates the tearing of one of the sheets of paper bound together by a conventional after-processing apparatus.

DETAILED DESCRIPTION OF THE PREFERRED EMBODIMENT

In the present invention, a clip fitting unit is capable of handling one of the conventional clip designs In the clip fitting unit, a clip storage means is provided, and when the copies are to be bound together by the clip, the end portions of the copies are curved toward the clip fitting unit so as to be easily inserted between the mutually opened tips of the clip. A projection can be provided at the clip send-out portion of the clip fitting unit so as to open the tips of the inner and outer portions of the clip to fit the clip to the copies.

Since either the staple driving unit or the clip fitting unit can be optionally set at the compiling tray of the after-processing apparatus, the copies can be bound together by either a staple or the clip, depending on the purpose or the intended use of the bound copies. If the copies are bound together by the clip, they can be easily separated when being copied again, to prevent tearing. Since different conventional clips can be used in the after-processing apparatus, the range of application thereof is wide.

Figure 1:
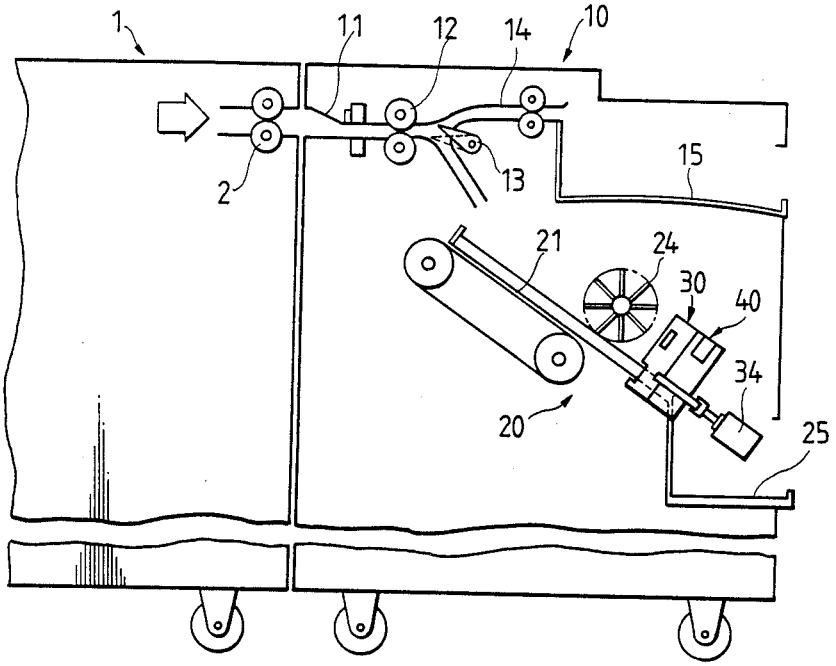
FIG. 1 shows a side view of an after-processing apparatus of the present invention coupled to a copying machine.

FIG. 1 shows an after-processing apparatus provided for a copying machine. The after-processing apparatus consists of finisher 10 coupled to the copying machine 1. The finisher 10 is provided with a paper conveyance passage through which a copy discharged from the copying machine 1 by discharge rollers 2 is introduced into the finisher. The paper conveyance passage is defined by a pair of upper and lower guide plates 11 to convey the copy by conveyance rollers 12. A claw 13 is provided at the halfway portion of the paper conveyance passage so that a copy is directed into either a discharge passage 14 or a conveyance passage that leads to a compiling tray 21. Copies not to be bound together are discharged into a tray 15 through the discharge passage 14.

A binding device 20 is provided under the claw 13 and includes the compiling tray 21 in which copies are fed to be trued up. The compiling tray 21 is provided with a staple driving unit 30 and a clip fitting unit 40 which are capable of being moved by a solenoid 34 so that one of the two units is set depending on the binding mode selected. The copies bound together in the compiling tray 21 are discharged into the discharge tray 25.

Figure 2:
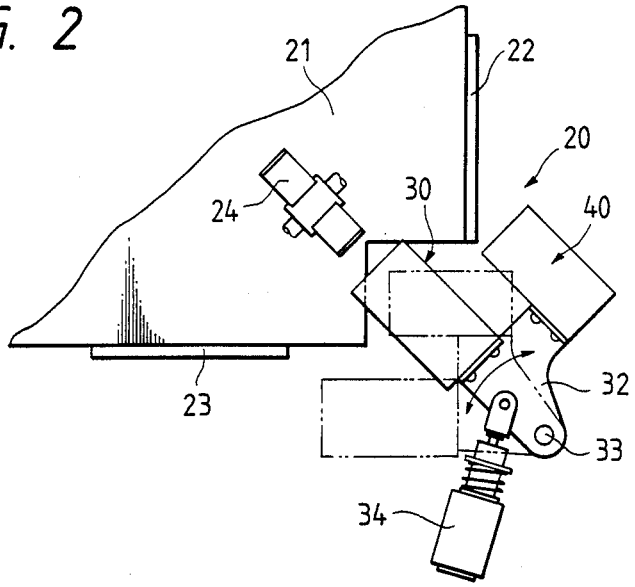
FIG. 2 shows a plan view of the binding device of the after-processing apparatus of FIG. 1.

FIG. 2 shows the relation between the compiling tray 21 and the binding device 20. A gate 22 is provided at the front end of the compiling tray 21 so that the gate can be opened and closed. A side guide 23 is provided at a side of the compiling tray 21. A paddle 24 is provided near one corner of the discharge portion of the compiling tray 21. The paddle 24 includes blades made of relatively soft material projecting from a rotary shaft as in a conventional paddle. The paddle 24 is rotated so that the copy discharged into the compiling tray 21 is obliquely conveyed and brought into contact with the gate 22 and the side guide 23 at the leading edge and side edge of the copy in order to be trued up.

A notch is provided at a corner of the compiling tray 21 so that one of the two binding means, which are the staple driving unit 30 and the clip fitting unit 40, can be set in the notch. The staple driving unit 30 and the clip fitting unit 40 can be rotated through the action of a bracket 32. The bracket 32 is rotated about a shaft 33 by a moving means such as the solenoid 34 so that the staple driving unit 30 is set in the notch obliquely to the corner of the copy or the clip fitting unit 40 is set in the notch nearly in parallel with the longitudinal direction of the compiling tray 21, as shown in FIG. 2. The two binding means are thus provided at the compiling tray 21 so that either of the binding means can be used to bind the copies together.

Figure 3:
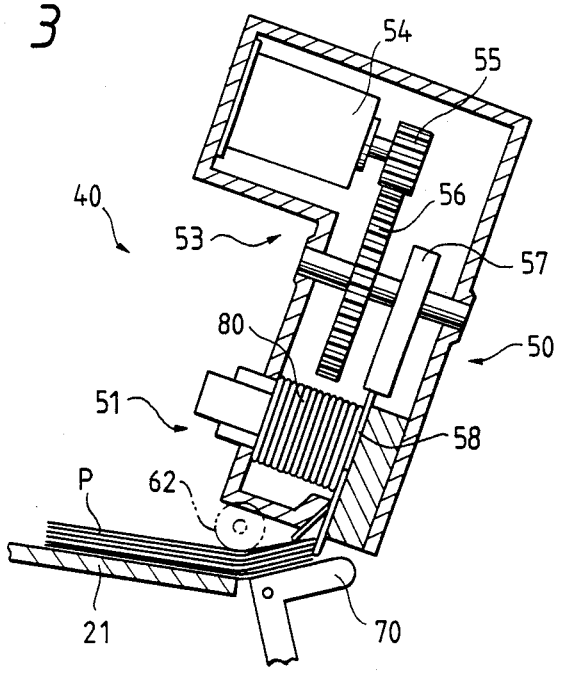
FIG. 3 shows a sectional view of the upper section of the clip fiting unit of the binding device of FIG. 1.
Figure 4:
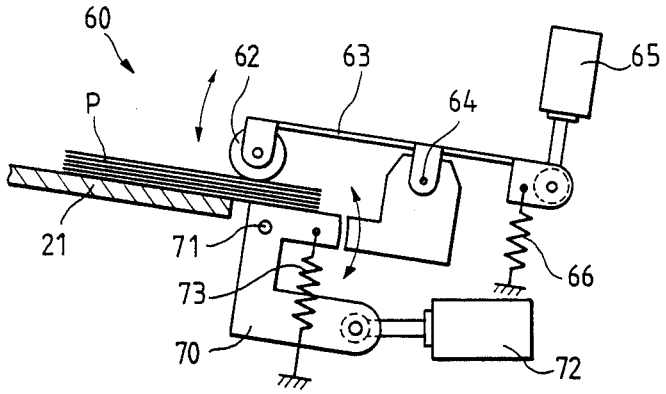
FIG. 4 shows a side view of the lower section of the clip fitting unit.
Figure 5:
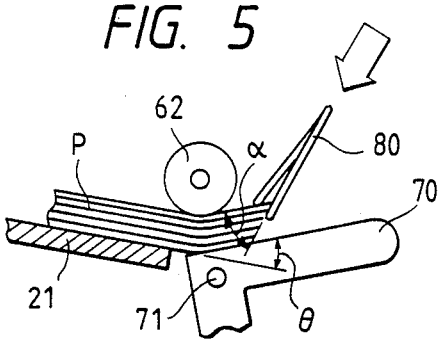
FIG. 5 shows a side view for illustrating the position of sheets of paper to be fitted with a clip by the clip fitting unit.

FIGS. 3, 4, and 5 show the construction of the clip fitting unit 40. The clip fitting unit 40 comprises an upper section 50 shown FIG. 3, and a lower section 60 shown in FIG. 4. The upper section 50 and the lower section 60 are combined together to bind the copies by a clip.

In the upper section 50 of the clip fitting unit 40, which is shown in FIG. 3, clips 80 are stored in a clip box 51 so that the clips are sent out one by one therefrom by a clip send-out plate 58. A means 53 for driving the clip send-out plate 58 comprises a motor 54, gears 55 and 56, and a cam 57. The clip send-out plate 58 is moved back and forth by the rotation of the cam 57 so that the clips 80 stored in the clip box 51 are discharged therefrom toward the area of the copies to be bound.

The design of the clip box 51 and clip send-out plate 58 of the upper section 50 can be determined depending on the form of clip 80, but the clip box and the clip send-out plate must be designed to dispense the clips individually.

The lower section 60 of the clip fitting unit 40, which is shown in FIG. 4, is engaged on the end portions of the uppermost and lowermost ones of the copies P to curve the end portions upward. For that purpose, the lower section 60 includes a clamping roller 62, which is engaged on the end portion of the uppermost one of the copies P to push them, and a paper curving arm 70, which is put in contact with the end portion of the lowermost one of the copies P to curve them at the end portions thereof.

The clamping roller 62 is supported by an arm 63 that can be swung about a shaft 64 by a solenoid 65 and a spring 66. When the solenoid 65 is energized, the arm 63 is swung counterclockwise (with regard to FIG. 4) about the shaft 64 to push the clamping roller 62 on the copies P. The paper curving arm 70 is swung by a solenoid 72 and a spring 73 about a shaft 71 provided in the body of the binding device 20. When the solenoid 72 is energized, the paper curving arm 70 in contact with the lowermost one of the copies P is swung counterclockwise (with regard to FIG. 4) so that the end portions of the copies P are curved upward as shown in FIG. 3, and as shown in detail in FIG. 5.

When the copies P are to be bound together by the clip 80 as shown in FIG. 5, the solenoids 65 and 72 are energized so that the end portions of the copies trued up in the compiling tray 21 are pushed downward by the clamping roller 62 and lifted by the paper curving arm 70 and are curved upward about the clamping roller. At that time, the leading edges of the copies P deviate from each other so that the angle of the upper corner of the stack of the copies becomes nearly equal to $(90°-\theta)$ where $\theta$ denotes the angle of the swing of the paper curving arm 70. As a result, the end portions of the copies P can be inserted into the clip 80, the tips of the inner and outer portions of which are opened beforehand. When the clip 80 is then pushed forth, it is moved on the copies P so that he tips of the inner and outer portions of the clip are opened from each other further and pinch the copies on the top and bottom of the stack of the copies strongly enough to hold the copies together.

At the clip fitting unit 40, the end portions of the copies are curved so that the leading edges of the copies deviate from each other as decribed above. After that, the copies are easily inserted into the clip 80, the tips of the inner and outer portions of which are already slightly opened away from each other. The clip 80 can thus be easily fitted to the copies without requiring a fitting means of complex construction, but instead by using a projection that is provided at the clip send-out portion of the clip fitting unit 40 so as to slightly open the tips of the inner and outer portions of the clip.

Figure 6:
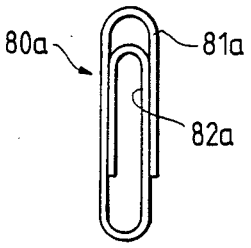
FIGS. 6, 7, 8, 9, 10 and 11 show clips, which can be handled by the clip fitting unit of the present invention.
Figure 7:
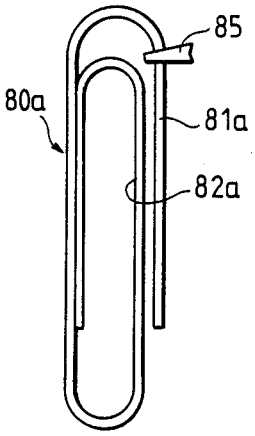

Conventional clips such as shown in FIGS. 6, 7, 8, 9, 10 and 11 can be used for the clip fitting unit 40. If the clip 80 is a Zem clip **80*a* as shown in FIG. 6, the tips of the inner and outer rings of the Zem clip must be opened when the clip is pushed out of the clip box 51 by the clip send-out plate 58, because the inner and outer rings of the clip are originally nearly parallel with each other. In order to open the tips of the inner and outer rings of the Zem clip 80*a*, a projection 85 is provided at the clip send-out portion of the upper section 50 as shown in FIG. 7, so that as the clip is pushed out of the clip box 51 the projection is located between the inner ring 82*a* and outer ring 81*a* of the clip. The tips of the inner and outer rings of the clip are thus opened by the projection 85. The corners of the copies and the clip are then slid together so that the copies are bound together by the clip 80*a***.

Figure 8:
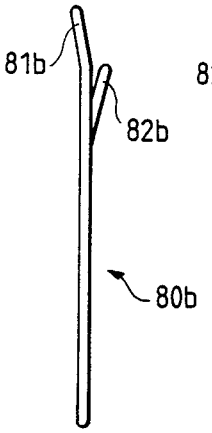
Figure 9:
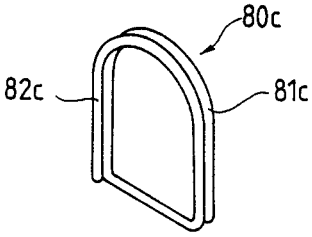

If the clip 80 is a clip **80*b* as shown in FIG. 8, a tip opener such as the projection 85 for the Zem clip 80*a* shown in FIG. 6 need not be provided because at least one of the inner ring 82*b* and outer ring 81*b* of the clip 80*b* is bent outwardly. For that reason, the clip 80*b*** can be easily fitted to the corner of the copies by engaging the clip on the acute-angled corner of the stack of the copies, without opening the tips of the inner and outer rings of the clip.

If the clip 80 is a modified Zem clip **80*c* (see FIG. 9) or a modified Zem clip 80*d* (see FIG. 10), a projection 85 such as shown in FIG. 7 should be provided in the clip fitting unit 40 to open the inner and outer rings of the clip as the clip is pushed out of the clip box 51 by the clip send-out plate 58. The clip 80*c* or 80*d*, the inner and outer rings of which are opened by the projection, can then be easily fitted to the copies curved upward by the clamping roller 62 and paper curving arm 70 of the lower section 50 of the clip fitting unit 40**.

Figure 11:
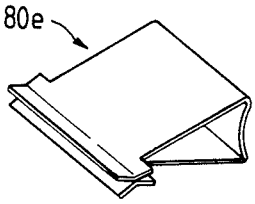
Figure 10:
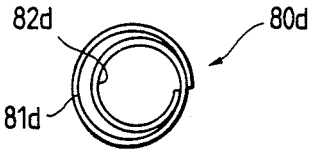
Figure 12A:
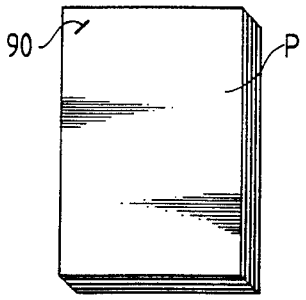
FIGS. 12(*a*) and 12(*b*) show views for illustrating sheets of paper bound in different ways.
Figure 12B:
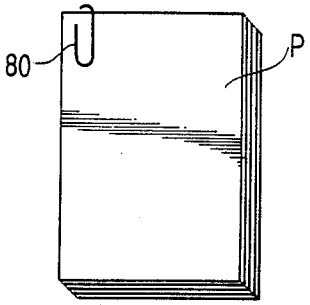
Figure 13:
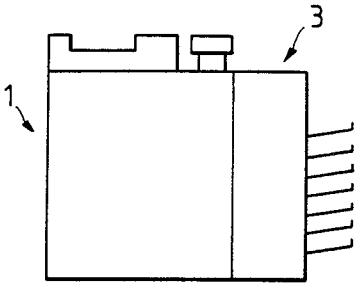
FIG. 13 illustrates a conventional after-processing apparatus connected to a copying machine.
Figure 14A:
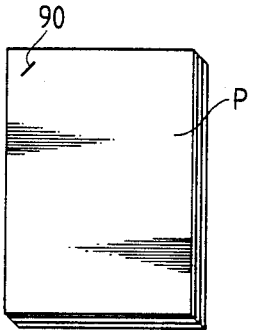
FIG. 14(*a*) illustrates sheets of paper bound together by the conventional after-processing apparatus.
Figure 14B:
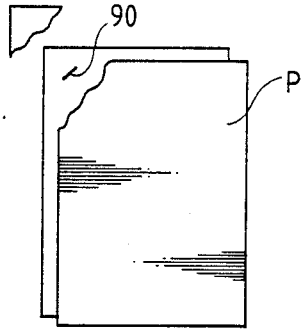

If the clip 80, which is used for the clip fitting unit 40, is a clip **80*e* made of a bent plate spring and not provided with handles, as shown in FIG. 11, a means for automatically opening the tips of the portions of the clip must be provided. Since the spring force of the clip 80*e* is usually strong, the opening means must open the tips of the end portions of the clip to fit the clip to the copies. Since the end portions of the copies do not need to be curved for the clip 80*e* shown in FIG. 11, the clamping roller 62 and paper curving arm 70 of the lower section 50 of the clip fitting unit 40** may be replaced with members capable of pushing the copies upward and downward respectively and holding them.

Thus, optional clips different in form and construction from each other can be used for the clip fitting unit 40 of the after-processing apparatus. A means for opening the portions of the clip is provided or not provided at the clip send-out portion of the lower section of the clip fitting unit, depending on the form and construction of the clip, as described above. In either case, the clip can be easily fitted to the copies by the clip fitting unit. The staple driving unit 30 of the binding device 20 of the after-processing apparatus may be a conventional one.

Although the staple driving unit 30 and the clip fitting unit 40 are swung by the solenoid 34 in the above-described embodiment so as to be set at the compiling tray 21, the present invention is not confined thereto but may be otherwise embodied so that an optional moving mechanism is provided to set either the staple driving unit or the clip fitting unit at the compiling tray depending on the binding mode of the after-processing apparatus.

Although the clamping roller 62, the paper curving arm 70, and so forth are provided in the above-described embodiment to curve the end portions of the copies, the present invention is not confined thereto, but may be otherwise embodied so that an optional mechanism is provided depending on the form of the clip and so forth to clamp the end portions of the copies and curve the end portions to make the angle of the corner of the stack of the copies sufficiently acute to fit the clip thereto.

What is claimed is:

1. An after-processing apparatus for a copy machine for binding copies together, the apparatus comprising:

a compiling tray for accumulating and aligning the copies to be bound, the compiling tray including a binding location corresponding to the area on said copies where binding occurs;

a binding device having a staple driving unit portion and a clip fitting unit portion, said staple driving unit portion and said clip fitting unit portion being selectively alignable with said binding location;

a positioner for selectively aligning the relative position of the staple driving unit portion and the clip fitting unit portion to the binding location of said compiling tray; and means for bending the end portion of the copies in said compiling tray such that a clip can be fitted to said copies at the bent end portions thereof.

2. An after-processing apparatus according to claim 1, further including a clip feeding mechanism in the clip fitting unit, said clip feeding mechanism including a projection for opening the tips of inner and outer portions of a clip as the clip is fed so that the clip can be fitted to the copies.

3. An after-processing apparatus according to claim 1, wherein said positioner includes a solenoid for selectively moving said staple driving unit and said clip fitting unit to a position proximate said binding location.

* * * * *